United States Patent [19]

Hatcher et al.

[11] 4,112,667

[45] Sep. 12, 1978

[54] APPARATUS AND PROCESS SUITABLE FOR TWIST-DRAWING A YARN

[75] Inventors: Charles S. Hatcher, Greenville, S.C.; Kenneth E. Smith, Bartlesville, Okla.

[73] Assignee: Phillips Petroleum Company, Bartlesville, Okla.

[21] Appl. No.: 770,551

[22] Filed: Feb. 22, 1977

[51] Int. Cl.[2] ..... D01H 13/04; D02G 3/00

[52] U.S. Cl. ..... 57/157 S; 57/106

[58] Field of Search ..... 57/157 S, 157 R, 106

[56] References Cited

U.S. PATENT DOCUMENTS 3,481,136 12/1969 Timmons, Jr. et al. ..... 57/157 S X 3,775,961 12/1973 Womer ..... 57/157 S

*Primary Examiner*—Charles Gorenstein

[57] ABSTRACT

A yarn is twist-drawn on an apparatus employing a 2-for-1 twist spindle; at least one guide roll positioned above the spindle; means suitable for receiving a yarn from said guide roll and drawing the yarn; and means suitable for winding the drawn yarn, wherein the guide roll comprises a cylindrical surface mounted on a shaft which is attached to a base suitable for positioning the cylindrical surface so that the yarn rides on the surface of the roll in a relatively fixed position and a substantial amount of twist is not trapped in the yarn ahead of the guide roll.

12 Claims, 3 Drawing Figures

APPARATUS AND PROCESS SUITABLE FOR TWIST-DRAWING A YARN

BACKGROUND OF THE INVENTION

The invention relates to an apparatus suitable for twist-drawing an undrawn or partially drawn yarn. In another aspect, the invention relates to a method suitable for twist-drawing an undrawn or partially drawn yarn.

The use of synthetic yarns presently dominates the textile industry. Although some natural fibers such as cotton and wool are still used today, the majority of yarns used to produce clothing, carpeting, upholstery material and other textile goods are primarily synthetic yarns. In order for synthetic yarns to resemble yarns made from natural fibers, it is necessary to texture or bulk the synthetic yarns. Texturing synthetic yarns in order that such yarns when made into fabrics will have the hand and feel of fabrics made from natural staple yarns is well known in the art. The various texturing processes used to texture synthetic yarns also employ a variety of feed yarns. For example, a feed yarn can be drawn, partially drawn or undrawn and a feed yarn can be twisted or entangled to bind the filaments in the yarn closer together because a yarn that is not twisted or entangled often has filaments that become separated from the yarn that can snag and break during the various processing steps. Also packages of feed yarn should be used in a size or weight best suited for the particular process used. Some of the more commonly employed texturing processes use a feed yarn that has been twisted and drawn. To produce such a feed yarn, a draw-twist machine is frequently used. Such a machine, which is well known in the art, draws an undrawn or partially drawn yarn and then twists the drawn yarn during windup by feeding the yarn to a rotating vertically mounted take-up bobbin through a rotatable "flyer" driven only by the angular momentum of the yarn. Although this type of machine works very well and is widely used, the packages of draw-twisted yarn that can be produced on such machines are relatively small because the windup bobbin itself must be rotated. In some texturing processes where large packages of feed yarn are desirable, it is necessary to splice and recone the draw-twisted yarn to make larger feed yarn packages. An additional problem associated with use of a draw-twisting machine is its relatively slow speed. Most draw-twist equipment operates in the area of 300 to 400 meters/minute and when higher speeds are attempted by using higher drawing speeds and/or draw ratios broken filaments occur.

An object of the invention is to produce large packages of yarn wherein the yarn has been twisted and drawn.

Another object of the invention is to produce drawn and twisted yarn at speeds substantially above 400 meters/minute without producing a yarn with an unacceptable number of broken filaments.

Another object of the invention is an apparatus suitable for producing large packages of yarn wherein the yarn has been twisted and drawn.

Still another object of the invention is an apparatus suitable for producing drawn and twisted yarn at speeds substantially above 400 meters/minute without producing a yarn with an unacceptable number of broken filaments.

SUMMARY OF THE INVENTION

According to the invention an apparatus comprises a 2-for-1 twist spindle; at least one guide roll positioned above the spindle; means suitable for receiving a yarn from the guide roll and drawing the yarns; and means suitable for winding the drawn yarn, wherein the guide roll comprises a cylindrical surface mounted on a shaft which is attached to a base suitable for positioning the cylindrical surface so that the yarn rides on the surface of the roll in a relatively fixed position and a substantial amount of twist is not trapped in the yarn ahead of the guide roll.

Further according to the invention, an essentially as spun yarn is passed from a twisting zone to a guiding zone, guiding the yarn from the twisting zone to a drawing zone without trapping substantial twist in the yarn ahead of the guiding zone, drawing the twisted yarn and winding the twisted and drawn yarn. Packages of twist-drawn yarn produced according to the invention are capable of being produced in much larger sizes or weights as compared to packages of yarn produced on equipment wherein the yarn is first drawn and then twisted. Further, twist-drawn yarn can be produced according to the invention at rates of production substantially above 400 meters/minute without a substantial number of broken filaments.

DETAILED DESCRIPTION OF THE INVENTION

Figure 1:
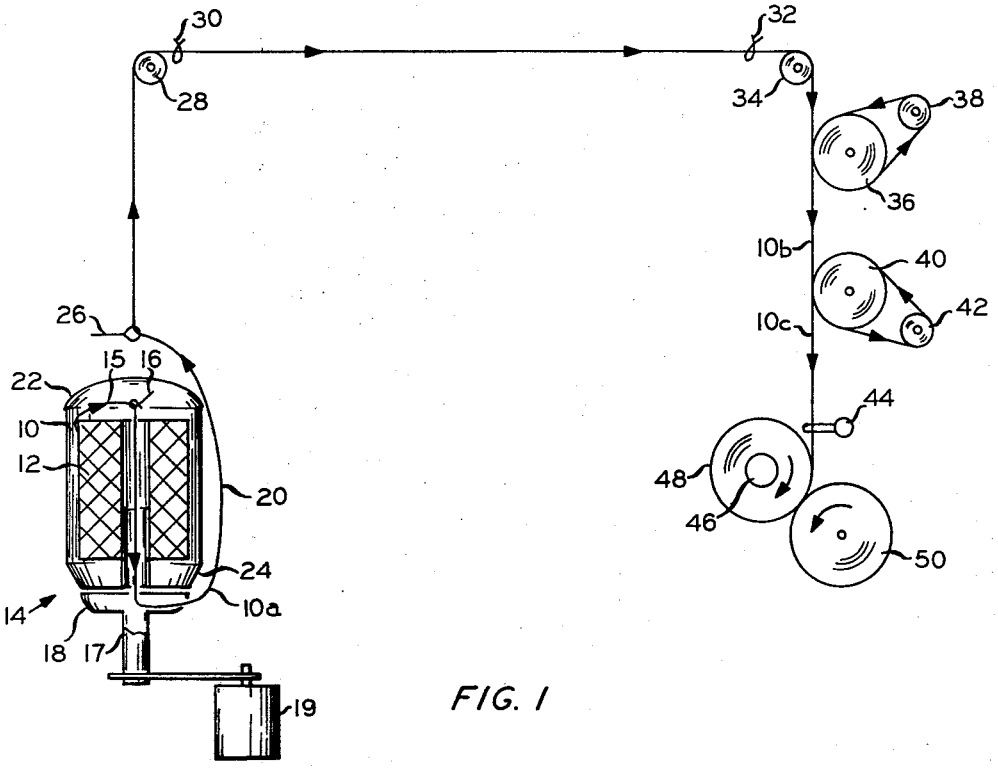
FIG. 1 shows schematically an embodiment of an apparatus of the present invention.

Referring to FIG. 1 of the drawing, an essentially as spun yarn 10, which is also known in the art as an undrawn or partially drawn yarn, wound on a package 12 which is supported on a 2-for-1 twister such as a Verdol twister manufactured by Verdol of Lyon, France, indicated generally by reference numeral 14, is passed through a guide 16 forming what is known in the art as the "inner balloon" 15. The yarn is then passed through the center of the package 12, disc 18, and around the outside of the twister to form what is known in the art as the "outer balloon" 20. Disc 18 is attached to spindle 17 that is rotated by power means 19. Can 22, supported on twist spindle mount 24, prevents contact between the inner balloon and the outer balloon. The twisted yarn **10*a* is gathered above the 2-for-1 twister at guide 26 and is passed around guide roll 28, positioned above the 2-for-1 spindle, through pigtail guides 30 and 32 and around guide roll 34. According to the invention, the guide rolls 28 and 34 must be of the type that will not trap twist in the yarn ahead of the guide rolls. This is an essential and critical requirement of the present invention. After wrapping around guide roll 34, the yarn is passed around feed roll 36 and idler roll 38, draw roll 40 and idler roll 42. The yarn 10*b* is drawn by draw roll 40 and idler roll 42 which rotates at a faster lineal speed than feed roll 36, thus drawing the twisted yarn. The draw ratio employed depends upon the degree of orientation of the as spun yarn, but generally ranges from about 2 to 1 to about 6 to 1. The twisted and drawn yarn 10*c* is wound as is known in the art, such as on package support 46 after passing through traversing means 44 to form a package of twistdrawn yarn 48. The package of yarn 48 is driven by rotating roll 50 which is in frictional contact with yarn package 48**.

Figure 2:
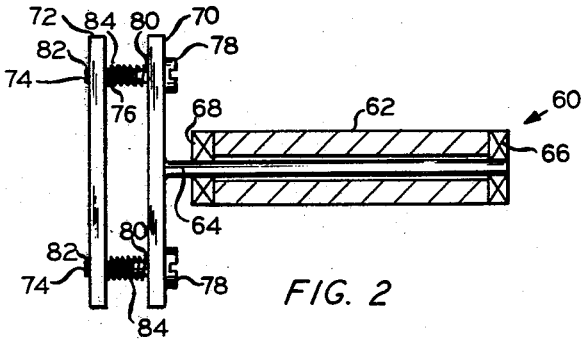
FIG. 2 shows a side view of a guide roll partially in section suitable for use in the apparatus of FIG. 1.
Figure 3:
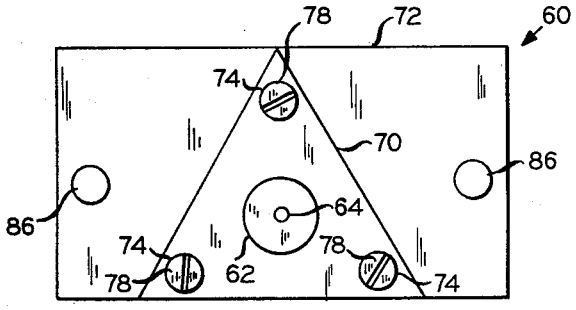
FIG. 3 shows an end view of the guide roll shown in FIG. 2.

In FIGS. 2 and 3 a specific embodiment of a guide roll, indicated generally by reference numeral 60, is shown which is suitable for use as guide rolls 28 and 34 of FIG. 1. In FIG. 2, guide roll 60 comprises a cylindrical surface 62 which is mounted on a shaft 64 by using bearings 66 and 68. The shaft 64 is attached to a base 70 which is attached to a mounting plate 72. Base 70 is attached to mounting plate 72 by using three screws 74 (shown clearly in FIG. 3) having a threaded portion 76 and a head portion 78. Screws 74 pass through smooth holes 80 in base 70 and are screwed into threaded holes 82 in mounting plate 72. The diameter of smooth holes 80 is such that the threaded portion 76 of screws 74 will pass through holes 80 but the head portion 78 will not pass through holes 80. Between base 70 and mounting plate 72 coil springs 84 are concentrically aligned with the threaded portion 76 of screws 74 which force base 70 against the head portion 78 of screws 74. By turning the screws 74 the cylindrical surface of guide rolls 60 can be adjusted to the proper angle so that the yarn 10*a* rides on the rolls in a relatively fixed position. Mounting plate 72 is equipped with holes 86 for attaching the guide roll 60 to the equipment.

Depending upon the type of yarn being processed, it may be desirable to employ heated rolls for feed roll 36 and draw roll 40.

The yarn used in the present invention is a synthetic multifilament as spun yarn. As used herein, the term "as spun yarn" means a continuous multifilament yarn having a tenacity of less than about 3.0 grams per denier. However, in most instances the as spun yarns used in the present invention will have a tenacity of less than about 2.0 grams per denier, and it is in processing the lower tenacity as spun yarns that the present invention is particularly useful. Most any type of synthetic filament yarn can be employed in the invention as long as it can be drawn. Generally, the yarn employed is a polyamide, polyester or polyolefin yarn; however, the use of other yarns is within the scope of the invention. Good results were obtained using polypropylene as the polyolefin yarn.

Yarns processed according to the method and apparatus of the present invention are normally processed at a rate ranging from about 600 to about 1000 meters per minute to produce a drawn yarn having a twist ranging from about 0.1 to about 1.0 twists per inch (tpi); however, rates ranging from about 800 to 900 meters per minute and a twist ranging from about 0.2 to about 0.8 tpi will probably be used most often.

It is recognized that twisting a yarn, such as by employing a 2-for-1 twister, and then drawing the twisted yarn is not a new process in the broad sense; however, such a process has been difficult to operate with feed yarns having a tenacity ranging from about 1.0 to 2.0 grams per denier satisfactorily because of filament breakage. As is well known in the art, as spun yarn has very low tenacity and consequently such yarn must be handled very carefully. This is true even after twisting the as spun yarn. It has been found that the type of guide roll is extremely important in the control of filament breakage. As an illustration of the criticality in the selection of the guide roll, guide rolls were used in the process and apparatus schematically shown in FIG. 1 in which the surface of the guide rolls had a "V" groove in order to control the position of the yarn riding on the guide rolls. "V" groove type rolls are commonly employed in all types of yarn processing equipment and heretofore were believed to be suitable for use on twistdraw equipment. The feed yarn was an as spun polypropylene 1750 denier 70 filament yarn having a tenacity of 1.3 grams per denier. The 2-for-1 twister was operated at 4000 rpm. The feed roll was operated at a linear speed of 145 meters per minute and the draw roll was operated at 678 meters per minute, thus the draw ration was 4.68. After only a short period of operation, the yarn broke out stopping the yarn processing after a number of attempts and after a number of various adjustments to the apparatus were made. There were a few instances where it took as long as 45 minutes to 1 hour for the yarn to break out, but such runs were the exception rather than the rule. However, the same yarn processed without incident after the guide rolls were changed out to rolls having a cylindrical surface similar to that of roll 60 shown in FIG. 2 and the roll was adjusted so that the yarn rode on the surface of the roll in a relatively fixed position. It is presently believed that the rolls having the cylindrical surface solved the problem with broken filaments because the "V" grooved roll tended to act as a twist trap causing a high degree of twist to build up in the yarn ahead of the roll whereas the roll with the cylindrical surface did not act as a twist trap.

The above illustration clearly demonstrates the surprising results obtained according to the invention by employing a guide roll having a cylindrical surface as compared to a guide roll with a "V" groove surface and the criticality in guide roll type and selection.

The term "2-for-1 twister" as used herein is intended to cover modifications known in the art that increase the twist ratio of a 2-for-1 twister from 2 twists per revolution of the spindle to 4 twists per revolution of the spindle, and thus the term "2-for-1 twister" is used in the specification and claims in the generic sense.

What is claimed is:

1. A method comprising:

passing an essentially as spun twisted yarn from a twisting zone to a guiding zone;

guiding the yarn from the twisting zone to a drawing zone, said guiding zone having at least one guiding member, each member having a cylindrical roller guide having an axis which is adjustable wherein the axis is adjusted so that the yarn rides on the surface of the roll in a relatively fixed position and substantial twist is not trapped in the yarn ahead of the guiding zone;

drawing the twisted yarn to produce a twisted and drawn yarn; and winding the thus twisted and drawn yarn.

2. The method of claim 1 wherein the yarn is drawn in the drawing zone at a ratio ranging from about 2 to 1 to about 6 to 1.

3. The method of claim 1 wherein the essentially as spun yarn is selected from the group consisting of polyamides, polyesters and polyolefins.

4. The method of claim 1 wherein the yarn is essentially polypropylene.

5. The method of claim 1 in which the twisting zone comprises a 2-for-1 twister.

6. The method of claim 1 wherein the twisted and drawn yarn is produced at a rate within the range of from about 600 to about 1000 meters per minute.

7. The method of claim 1 wherein the twisted and drawn yarn has a twist ranging from about 0.1 to about 1.0 twists per inch.

8. The method of claim 1 wherein the twisted and drawn yarn is produced at a rate within the range of from about 800 to 900 meters per minute.

9. The method of claim 1 wherein the twisted and drawn yarn has a twist ranging from about 0.2 to 0.8 twists per inch.

10. The method of claim 1 wherein the essentially as spun yarn has a tenacity of less than about 3.0 grams per denier.

11. The method of claim 1 wherein the essentially as spun yarn has a tenacity of less than about 2.0 grams per denier.

12. The method of claim 1 wherein the essentially as spun yarn has a tenacity ranging from about 1.0 to about 2.0 grams per denier.

* * * * *